US006837421B1

(12) United States Patent
Li et al.

(10) Patent No.: US 6,837,421 B1
(45) Date of Patent: Jan. 4, 2005

(54) BUFFER PACKING APPARATUS

(75) Inventors: Ming-Wei Li, Taipei (TW); Chia-Chen Yu, Taipei (TW)

(73) Assignee: Arima Computer Corporation, Taipei (TW)

( * ) Notice: Subject to any disclaimer, the term of this patent is extended or adjusted under 35 U.S.C. 154(b) by 0 days.

(21) Appl. No.: 10/605,346

(22) Filed: Sep. 24, 2003

(51) Int. Cl.[7] ..... B65D 5/49; B65D 25/04
(52) U.S. Cl. ..... 229/120.32; 206/593; 229/120.33
(58) Field of Search ..... 229/120.32, 120.33, 229/120.34, 120.36; 206/587, 591, 593; 220/512, 513, 554; 217/26, 26.5

(56) References Cited

U.S. PATENT DOCUMENTS 1,708,890 A * 4/1929 Lowe ..... 217/26.5
2,617,524 A * 11/1952 Rosenberg ..... 229/120.32
3,656,611 A * 4/1972 Mertz ..... 229/120.32
4,180,164 A * 12/1979 Durden et al. ..... 229/120.32
4,934,589 A * 6/1990 Stephenson et al. ... 229/120.32
5,335,846 A * 8/1994 Smith et al. ..... 229/120.32
5,398,808 A * 3/1995 Chen et al. ..... 206/591
6,227,370 B1 * 5/2001 Earnshaw et al. ..... 229/120.33

* cited by examiner

*Primary Examiner*—Gary E. Elkins
(74) *Attorney, Agent, or Firm*—Jiang Chyun IP Office

(57) ABSTRACT

A buffer packing apparatus for packing a plurality of objects is provided. The buffer packing apparatus comprises a plurality of rectangular partition boards and a plurality of buffer columns. The rectangular partition boards form a plurality of compartments for buffering and accommodating the objects. Through the selection of different buffer column designs, orientation of the objects inside the buffer packing apparatus can be easily identified. With chamfers on every corner of the buffer packing apparatus, the shock produced by an external impact can be readily absorbed thereby increasing the buffering capacity of the packing.

15 Claims, 6 Drawing Sheets

BUFFER PACKING APPARATUS

BACKGROUND OF INVENTION

1. Field of the Invention

The present invention relates to a buffer packing apparatus. More particularly, the present invention relates to a buffer packing apparatus for packing a plurality of objects.

2. Description of the Related Art

Before packing up an object for transportation, some buffering material is normally placed inside a packaging box to pack the object and provide some space for buffering damages due to impact. In the earlier days, lightweight and easy-to-manufacture buffering materials such as polyurethane or plastic were used. In recent years, however, with environmental protection fresh in everybody's mind, material fabricated from paper gradually replaces the conventional polyurethane or plastic in packing things up for delivery. Nowadays, the most common buffering material includes molded packing apparatus or properly cut and folded cardboard. Because folded cardboard is easier and cheaper to manufacture, this type of packing is wildly used.

FIG. 1 is a perspective view showing a conventional buffer packing apparatus 100. The buffer packing apparatus utilizes two pieces of folded cardboard to produce buffer columns 101 at each corner and a wallboard 102 on each side. A plurality of partition boards 103 is also used to partition the packing apparatus into a plurality of empty slots 104 for accommodating various packing objects. In a conventional design, the objects to be packages such as a liquid crystal display (LCD) panel or a notebook computer are inserted into the respective space between the partition boards 103. The supporting walls 101*a* of the buffer columns 101 and the wallboards 102 not only provide support to the packing apparatus but also fix the objects in position so that a rigid packing apparatus is obtained. Because the pack objects are in direct contact with the wallboards 102, the buffering effect close to the wallboards 102 is poor. Furthermore, with a right-angled design for all four corners, the outer edge of the buffer columns 101 are also in direct contact with the packing box. Hence, any external impact on the packing box is likely to cause some structural damage to the buffer column 101 leading to possible collapse of the buffering capacity of the entire buffer packing apparatus.

SUMMARY OF INVENTION

Accordingly, one object of the present invention is to provide a buffer packing apparatus that provides a space for accommodating an object and protecting the object from possible damage due to an external impact.

To achieve these and other advantages and in accordance with the purpose of the invention, as embodied and broadly described herein, the invention provides a buffer packing apparatus for packing a plurality of objects. The buffer packing apparatus comprises a plurality of rectangular partition boards and a plurality of buffer columns. The rectangular partition boards are parallel to but separated from each other by a fixed distance for supporting objects. All corners of the rectangular partition boards have chamfers. Furthermore, the side edges of each rectangular partition boards adjacent to the chamfered corner has a plurality of first slots. The buffer columns are flushed into all the corners of the rectangular partition boards to form buffering spaces. Each buffer column has a plurality of second slots. The second slots on the buffer columns and the first slots on the rectangular partition boards mesh with each other so that the buffer columns and the rectangular partition boards together form an apparatus with a plurality of spatial compartments.

In one embodiment of this invention, each buffer column has a U-shaped column body with each U-shaped body comprising a support wall and two meshing walls. Both the support wall and the meshing walls mesh with the rectangular partition walls. The support wall serves as a supporting column for the objects. The meshing walls are attached to the support wall but folded in a direction perpendicular to the support wall. Furthermore, the second slots on the U-shaped column body extend from the support wall into the meshing walls.

In another embodiment of this invention, each buffer column comprises a pair of U-shaped column bodies and a connecting wall. The U-shaped column bodies are located on each side adjacent to the chamfers. Each U-shaped column body is constructed from a support wall and a pair of meshing walls. Both the support wall and the meshing walls mesh into the rectangular partition boards. The support wall serves as a supporting column for the objects. The meshing walls are attached to the support wall but folded into a direction perpendicular to the support wall. Furthermore, the second slots on the U-shaped column body extend from the support wall into the meshing walls.

Note that the connecting wall not only encloses the chamfers of the rectangular partition walls but also extends along the adjacent side edges of the rectangular partition boards to connect with U-shaped column bodies close to the chamfers. In this embodiment, the connecting wall is connected to the meshing wall of the U-shaped column body furthest from the chamfers, for example.

In yet another embodiment of this invention, buffer columns comprising just a U-shaped column body are set on some of the corners of the rectangular partition boards. Buffer columns comprising a pair of U-shaped column bodies connected via a connecting wall are set on the remaining corners of the rectangular partition boards. With this arrangement, packaging personnel can easily identify the orientation of various objects inside the packing apparatus.

In this embodiment, the corners connecting the respective meshing walls with the support wall have no chamfer.

In one embodiment, each side edge of the rectangular partition boards between the buffer columns has a buffer slot so that the rectangular partition board has the capacity to absorb a portion of the stress caused by an external impact.

In one embodiment, the rectangular boards and the buffer columns constituting the buffer packing apparatus are fabricated using chevron paper, packaging paper or paper-like material.

In addition, the chamfers on the rectangular partition boards provide an additional gap between the outer edges each buffer column and a packing box after the buffer packing apparatus is lowered into a packing box. Hence, the degree of damage to the buffer columns when the packing box receives an external impact will be greatly minimized. In other words, the buffer packing apparatus of this invention will have a higher structural strength.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
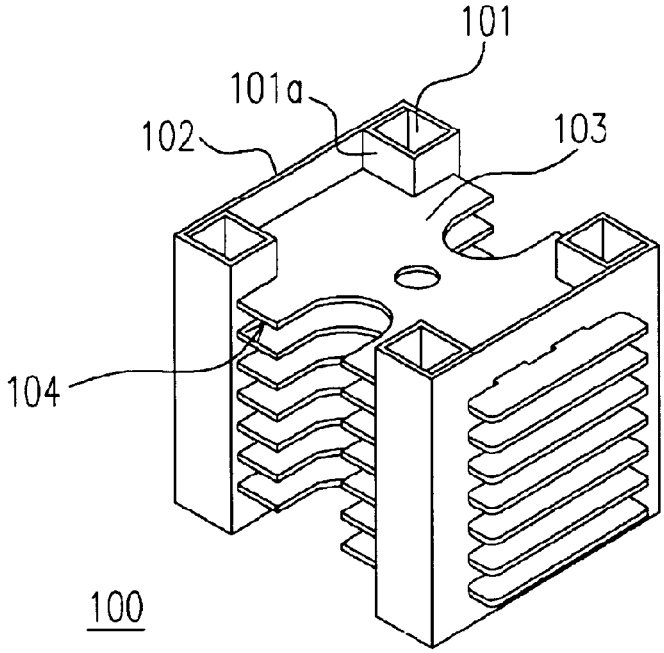
FIG. 1 (PRIOR ART)
FIG. 1 is a perspective view showing a conventional buffer packing apparatus.

Reference will now be made in detail to the present preferred embodiments of the invention, examples of which are illustrated in the accompanying drawings. Wherever possible, the same reference numbers are used in the drawings and the description to refer to the same or like parts.

Figure 2:
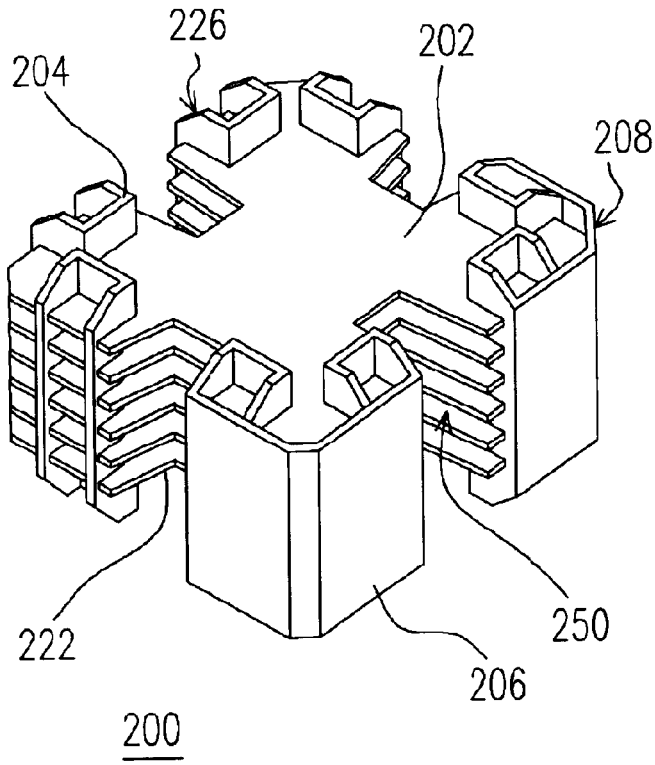
FIG. 2 is a perspective view showing a buffer packing apparatus according one embodiment of this invention.
Figure 3:
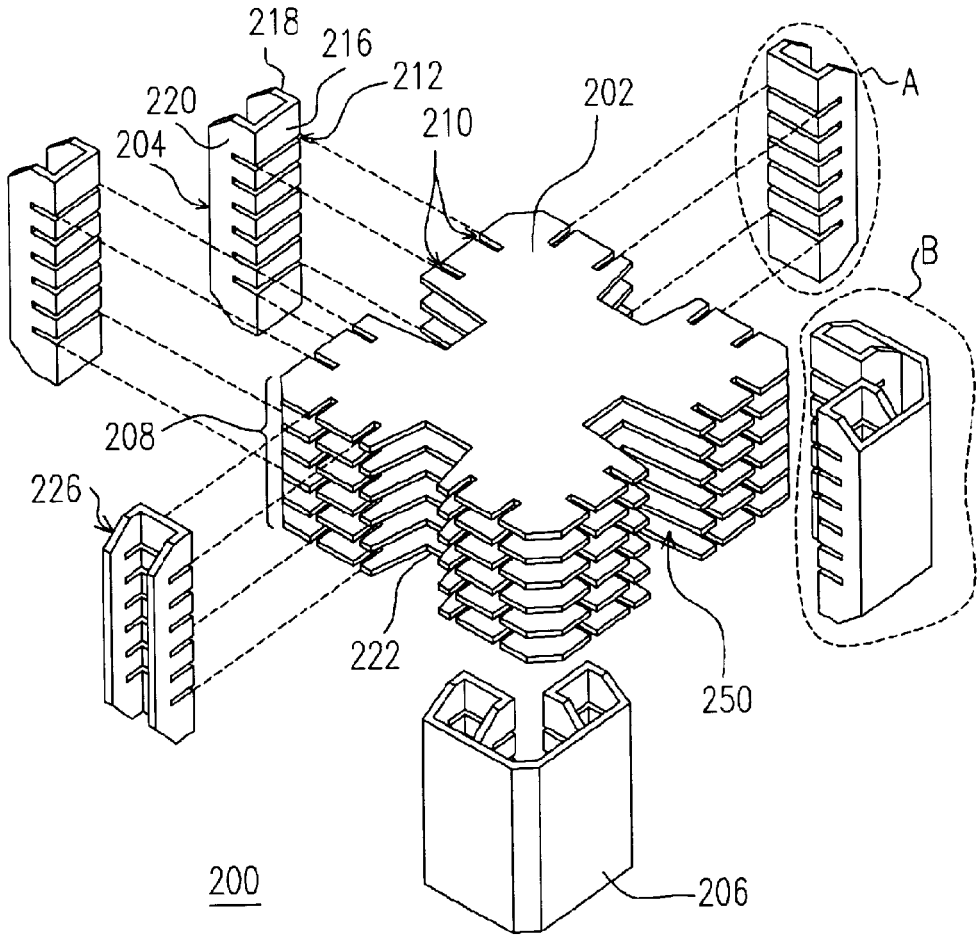
FIG. 3 is an exploded view showing the components of a buffer packing apparatus of this invention.

FIG. 2 is a perspective view showing a buffer packing apparatus according one embodiment of this invention. FIG. 3 is an exploded view showing the components of a buffer packing apparatus according to one embodiment of this invention. As shown in FIG. 3, the buffer packing apparatus 200 comprises a plurality of rectangular partition boards 202, eight U-shaped column bodies 204 and a pair of connecting walls 206. The rectangular partition boards 202 are set at a fixed distance apart but parallel to each other. All corners of each rectangular partition board are chamfered 208. Furthermore, the two side edges of the rectangular partition board close to each chamfer 208 has a set (for example, two) of first slots 210. In addition, the side edge of each rectangular partition between the two sets of first slots 210 has a buffer slot 222, for example.

As shown in FIGS. 2 and 3, the U-shaped column bodies 204 mesh with the respective corners of the rectangular partition boards to serve as buffer columns. The U-shaped column bodies 204 together with the rectangular partition boards 202 form a plurality of spatial compartments 250. Each U-shaped column body 204 comprises a support wall 216 and a pair of meshing walls 218 and 220. The meshing walls 218 and 220 connect with the respective sides of the support wall 216 but the meshing walls 218 and 220 are folded in a direction perpendicular to the support wall 216. Moreover, the side edges (or corners) of the meshing walls 218, 220 away from the support wall 216 have chamfers 226. Furthermore, each U-shaped column body 204 has a plurality of second slots 212 extending from the support wall 216 into both meshing walls 218 and 220. When the second slots 212 on a U-shaped column body 204 mesh with corresponding first slots 210 on the edges of the rectangular partition boards 202, the entire U-shaped column body 204 is embedded within the rectangular partition boars 202. Furthermore, after meshing the U-shaped column bodies 204 and the rectangular partition boards 202 together, the support walls 216 can serve as physical supports for the packing objects. Aside from enclosing two neighboring chamfers 208, the two connecting walls 206 also extend from the respective chamfers 208 along adjacent sides and connect with a buffer column having a configuration similar to the aforementioned U-shaped column body 204. In the following, a buffer column having just a simple U-shaped column body 204 is referred to as an "A" type buffer column. On the other hand, a buffer column having two U-shaped column bodies 204 connected via a connecting wall 206 is referred to as a "B" type buffer column.

Figure 4:
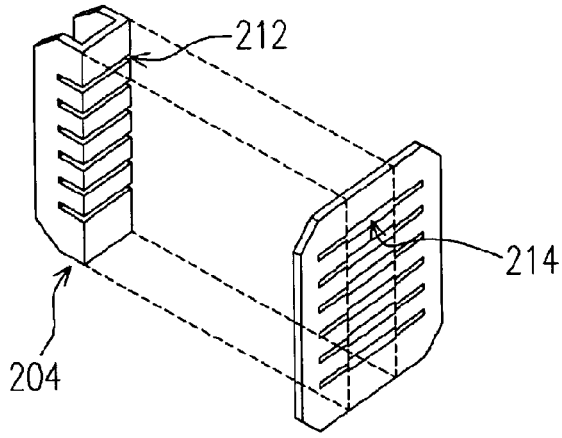
FIG. 4 is an expanded out version of an "A" type buffer column of the buffer packing apparatus of this invention.

FIG. 4 is an expanded out version of an "A" type buffer column according to this invention. As shown in FIG. 4, the U-shaped column body 204 is fabricated by folding a flat chevron paper with three fold sections. The second slots 212 on the U-shaped column body 204 is formed, for example, by cutting grooves 214 on the flat three-fold chevron paper before folding.

Figure 5:
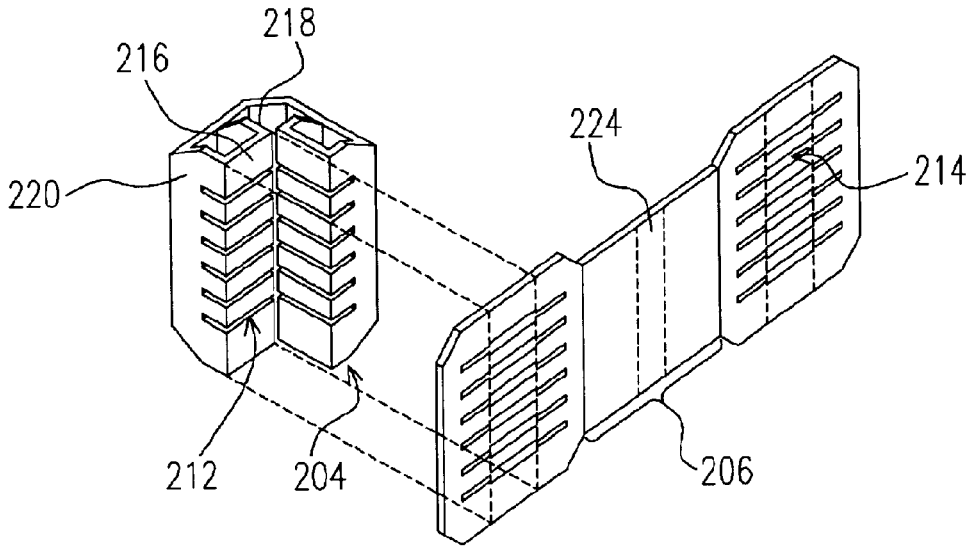
FIG. 5 is an expanded out version of an "B" type buffer column of the buffer packing apparatus of this invention.

FIG. 5 is an expanded out version of an "B" type buffer column according to this invention. As shown in FIG. 5, the "B" type buffer column is formed by folding a flat chevron paper that includes a section for the connecting wall 206 and two sections for the U-shaped column bodies 204. In this embodiment, the connecting wall 206 connects with the side of the meshing walls 220 of the U-shaped column body 204 away from the chamfers 208. Furthermore, the rectangular wall 224 of the connecting wall 206 encloses the chamfer 208 at the corner of the rectangular partition board 202. The second slots 212 on the U-shaped column body 204 is formed, for example, by cutting grooves 214 on the flat chevron paper before folding.

Figure 6:
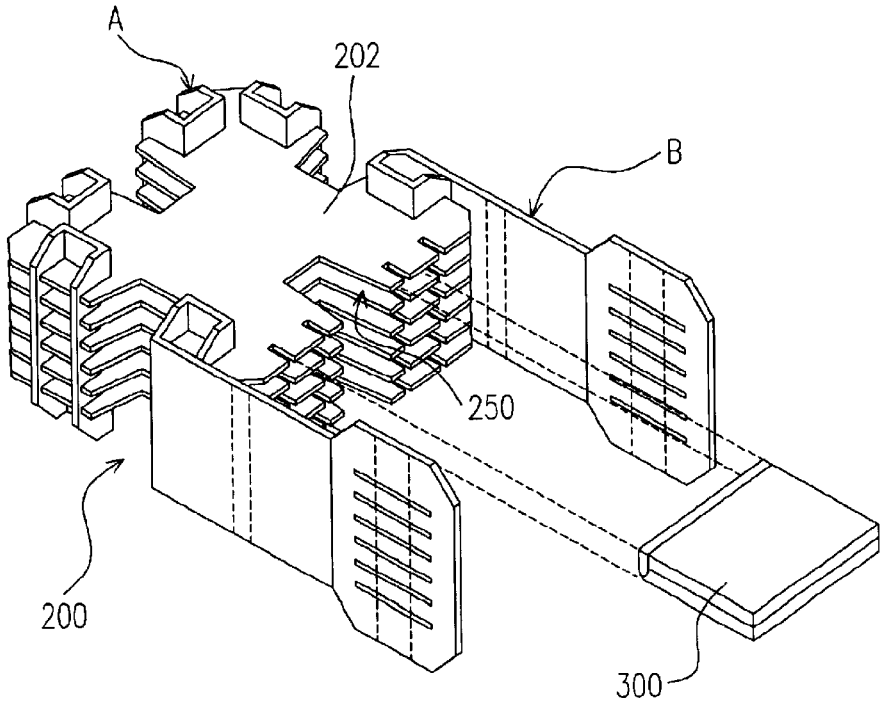
FIG. 6 is a perspective view showing the process of assembling the buffer packing apparatus of this invention.

FIG. 6 is a perspective view showing the process of assembling a buffer packing apparatus according to this invention. To package an object 300, an operator may select one of the sides for sliding the object 300 into the buffer packing apparatus 200. After slipping the object 300 into the buffer packing apparatus 200, the orientation of the object 300 inside the packing apparatus 200 can be identified through the setting of the buffer columns. For example, the object 300 is slipped into one of the compartments 250 of the buffer packing apparatus 200 by opening up the two "B" type buffer columns.

Figure 7:
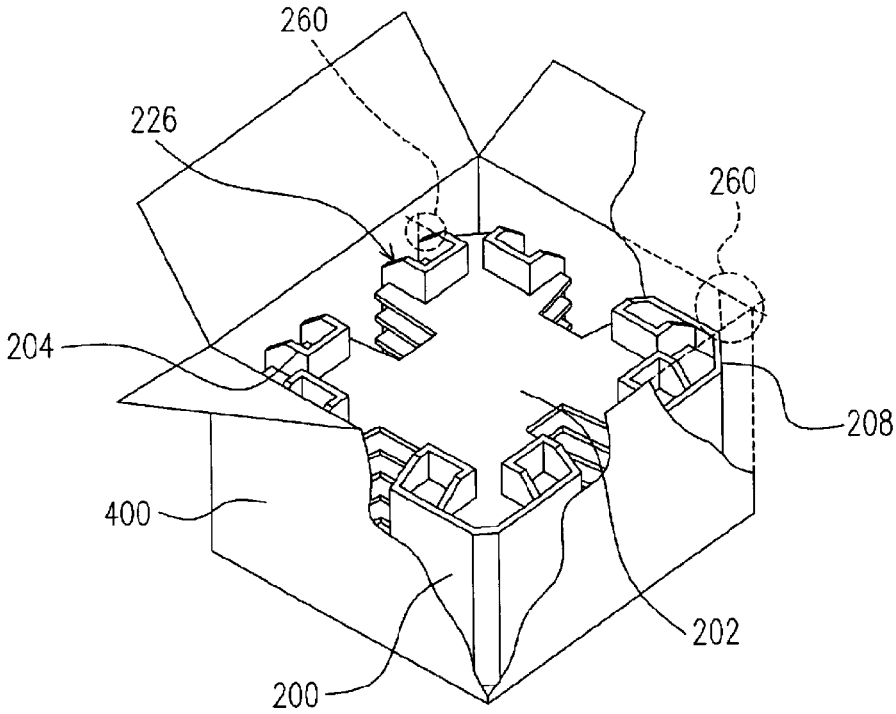
FIG. 7 is a perspective view showing a buffer packing apparatus according to this invention inside a packing box.

FIG. 7 is a perspective view showing a buffer packing apparatus according to this invention inside a packing box. As shown in FIG. 7, the entire buffer packing apparatus 200 is lowered into a packaging box 400. With chamfers 208 or 226 on every corner of the buffer packing apparatus 200, gaps 260 are produced that minimize the extent of direct contact with the packaging box 400. When the edges of the packaging box 400 receives an impact, the degree of damage to the U-shaped column bodies 204 is reduced and the buffering capacity of the packing apparatus 200 is enhanced.

Aside from using chevron paper, other type of materials including packaging paper, paper-like or buffering material can also be used to form the buffer packing apparatus. Furthermore, although four type "A" buffer columns and two type "B" type of buffer columns are used in the aforementioned packing apparatus, the buffer columns can be all "A", all "B" or various combinations of "A" and "B". Through a variation in the positioning of the buffer columns, the orientation of the objects within the packing apparatus can be readily identified.

In addition, the chamfers on the rectangular partition boards and the meshing walls of the U-shaped column bodies provide additional gaps between the buffer columns and a packaging box. Therefore, the degree of damage on the buffer columns when the packaging box receives an impact is greatly minimized. In other words, overall strength of the buffer packing apparatus is increased.

It will be apparent to those skilled in the art that various modifications and variations can be made to the apparatus of the present invention without departing from the scope or spirit of the invention. In view of the foregoing, it is intended that the present invention cover modifications and variations of this invention provided they fall within the scope of the following claims and their equivalents.

What is claimed is:

1. A buffer packing apparatus for packing a plurality of objects, comprising:

a plurality of rectangular partition boards parallel to and separated from each other by a specified distance so that the plurality of objects are supported, and each corner of each of the plurality of rectangular partition boards has a chamfer and side edges of each of the plurality of rectangular partition boards adjacent to the chamfers have a plurality of first slots; and a plurality of buffer columns meshing with the plurality of rectangular partition boards near the corners to form buffering spaces having a plurality of second slots meshing with the plurality of first slots on the side edges of the plurality of rectangular partition boards to form a plurality of compartments for accommodating objects.

2. The buffer packing apparatus of claim 1, wherein each buffer column is a U-shaped column body having:

a support wall meshing into the rectangular partition boards to support the objects; and a pair of meshing walls meshing into the rectangular partition boards, wherein each meshing wall is attached to one side of the support wall and set in a direction perpendicular to the support wall.

3. The buffer packing apparatus of claim 2, wherein the second slots on the U-shaped column bodies extend from the support wall into the meshing walls so that the buffer columns can mesh into the rectangular partition boards.

4. The buffer packing apparatus of claim 2, wherein the side of the meshing walls not attached to the support wall has chamfered corners.

5. The buffer packing apparatus of claim 1, wherein each buffer column furthermore comprises:

a pair of U-shaped column bodies meshing into the respective sides of a chamfered corner of the rectangular partition boards, and each U-shaped column body having:

a support wall meshing into the rectangular partition boards to support the wrap objects; and a pair of meshing walls meshing into the rectangular partition boards, wherein each meshing wall is connected to the support wall and set in a direction perpendicular to the support wall; and a connecting wall enclosing the chamfered corner of the rectangular partition boards and extending along adjacent sides of the board to connect with two U-shaped column bodies.

6. The buffer packing apparatus of claim 5, wherein the connecting wall attaches to the side of the meshing walls away from the chamfered corners.

7. The buffer packing apparatus of claim 5, wherein the second slots on the buffer columns extend from the support wall to a portion of the meshing walls.

8. The buffer packing apparatus of claim 5, wherein the side of the meshing walls not attached to the support wall has chamfered corners.

9. The buffer packing apparatus of claim 1, wherein the edges of each rectangular partition board between neighboring buffer columns have a buffering slot.

10. The buffer packing apparatus of claim 1, wherein material constituting the rectangular partition boards and the buffer columns is selected from a group of material consisting of chevron paper, packaging paper and paper-like substance.

11. A buffer packing apparatus for packing objects, comprising:

a plurality of rectangular partition boards parallel to each other and separated from each other by a specified distance for accommodating the objects, wherein each rectangular partition board has chamfered corners, and the sides of the rectangular partition board close to the chamfered corner have a plurality of first slots;

a plurality of U-shaped column bodies meshing into the sides of chamfered corners, wherein each U-shaped column bodies has a plurality of second slots such that the second slots on the U-shaped column bodies mesh with the first slots on the edges of the rectangular partition boards, furthermore each U-shaped column bodies having:

a support wall meshing into the rectangular partition boards to support the wrap objects; and a pair of meshing walls meshing into the rectangular partition boards, wherein each meshing wall is connected to the support wall but set in a direction perpendicular to the support wall; and a connecting wall enclosing the chamfered corner of the rectangular partition boards and extending along adjacent sides of the board to connect with two U-shaped column bodies.

12. The buffer packing apparatus of claim 11, wherein the second slots on the U-shaped column bodies extend from the support wall to the meshing walls.

13. The buffer packing apparatus of claim 11, wherein the edges of the rectangular partition boards between neighboring the U-shaped column bodies have a buffering slot.

14. The buffer packing apparatus of claim 11, wherein material constituting the rectangular partition boards and the buffer columns is selected from a group of material consisting of chevron paper, packaging paper and paper-like substance.

15. The buffer packing apparatus of claim 11, wherein the side of the meshing walls not attached to the support wall has chamfered corners.

* * * * *